US005806967A

United States Patent [19]

Soorus et al.

[11] Patent Number: 5,806,967

[45] Date of Patent: Sep. 15, 1998

[54] UPLIGHT WITH REMOVABLE BAFFLES

[75] Inventors: Armas D. Soorus, Dorr; David C. Eberlein, Hudsonville, both of Mich.

[73] Assignee: Steelcase Inc., Grand Rapids, Mich.

[21] Appl. No.: 798,918

[22] Filed: Feb. 12, 1997

[51] Int. Cl.[6] ..... F21S 3/00

[52] U.S. Cl. ..... 362/223; 362/260; 362/351; 362/801

[58] Field of Search ..... 362/260, 223, 362/224, 221, 225, 801, 351

[56] References Cited

U.S. PATENT DOCUMENTS

| | | | |
|---|---|---|---|
| 2,544,708 | 3/1951 | Margolis . | |
| 2,606,998 | 8/1952 | Winkler et al. . | |
| 2,777,053 | 1/1957 | Lipscomb | 362/224 |
| 3,192,380 | 6/1965 | Eglowstein . | |
| 4,204,274 | 5/1980 | Luderitz | 362/239 |
| 4,323,955 | 4/1982 | Mark | 362/278 |
| 4,351,017 | 9/1982 | Ball . | |
| 4,494,175 | 1/1985 | Gawad et al. | 362/291 X |
| 4,573,111 | 2/1986 | Herst et al. | 362/337 |
| 4,680,684 | 7/1987 | Wolber | 362/223 |
| 4,725,931 | 2/1988 | Bourdon . | |
| 4,876,633 | 10/1989 | Engel | 362/223 |
| 4,933,820 | 6/1990 | Engel | 362/217 |
| 4,939,627 | 7/1990 | Herst et al. . | |
| 5,025,355 | 6/1991 | Harwood | 362/147 |
| 5,051,878 | 9/1991 | Ngai . | |
| 5,062,030 | 10/1991 | Figueroa . | |
| 5,111,370 | 5/1992 | Clark . | |
| 5,188,449 | 2/1993 | Davis et al. | 362/148 |
| 5,192,129 | 3/1993 | Figueroa . | |
| 5,217,301 | 6/1993 | Munz et al. . | |
| 5,272,608 | 12/1993 | Engle . | |
| 5,274,533 | 12/1993 | Neary et al. . | |
| 5,276,597 | 1/1994 | Herst et al. . | |
| 5,343,373 | 8/1994 | Tillotson . | |
| 5,473,522 | 12/1995 | Kriz et al. . | |
| 5,510,965 | 4/1996 | Teakell . | |

*Primary Examiner*—Ira S. Lazarus
*Assistant Examiner*—Nhat-Hang A. Lam
*Attorney, Agent, or Firm*—Price,Heneveld,Cooper, DeWitt & Litton

[57] ABSTRACT

A light fixture having a uplight shade with an elongate downlight aperture includes a removable baffle configured to cover the elongate downlight aperture to control the amount of downwardly directed light. The light fixture includes an elongate ballast/electronic housing having opposing ends, and elongate side panel having opposing ends, and a pair of end pieces supportingly engaging the opposing ends of the ballast/electronic housing and the opposing ends of the side panels. The housing and side panel are laterally spaced apart, and together with the end pieces define an elongate downlight aperture. The side panel is positioned and orientated with respect to a light source mounted between the end pieces to act as a shade which reflects light upwardly from the light fixture.

12 Claims, 4 Drawing Sheets

UPLIGHT WITH REMOVABLE BAFFLES

FIELD OF THE INVENTION

This invention relates generally to office lighting fixtures, and more particularly to office lighting fixtures which can be mounted where desired on or above partition walls of modular furniture and which provide indirect ambient lighting.

BACKGROUND OF THE INVENTION

Open office plans are well known and generally comprise large, open floor spaces that are partitioned into individual workstations by movable panels which are typically configured to receive hang-on furniture units. Such partition panels and hang-on furniture arrangements are usually known in the office furniture industry as systems furniture. The systems furniture can normally be reconfigured as needed to allow great flexibility in adapting the available office space to changing business needs and facilitating efficient use of the office space. Desirably, the systems furniture and open office space in which the systems furniture is arranged are designed so that the partition walls can be located where desired within the confines of the open floor spaces, generally without regard to floor or overhead fixtures, such as lighting fixtures. However, conventional sources of ambient lighting, such as troffers for fluorescent lighting tubes, generally cannot be easily relocated. As a consequence, it can be extremely difficult to properly configure systems furniture in an open floor space which is lighted with ceiling mounted lighting fixtures so that light is well distributed throughout all of the individual workstations defined by the modular systems furniture layout. For example, modular offices or workstations situated between ceiling mounted lighting fixtures could be poorly lighted as compared with other modular offices or workstations which are located directly beneath a ceiling mounted lighting fixture. Accordingly, architectural lighting fixtures (i.e., lighting fixtures which are mounted to the permanent architectural features of the building, such as the walls or ceilings) are not well suited for providing uniform ambient lighting in open office spaces partitioned into individual workstations or office modules by partition panels of systems furniture.

Indirect lighting fixtures which are mounted to the architectural features of the building can provide improved light distribution. However, the quality of the lighting environment is still dependent to a large degree on placement of the systems furniture in relation to the normally fixed placement of the sources of indirect lighting. Additionally, it is often desirable to provide a combination of direct and indirect light to achieve proper illumination and ambiance without causing glare, such as off of computer display screens.

Movable indirect lighting fixtures for use in open office plans are limited as to where they can be placed. Known movable lighting fixtures include floor standing indirect HID and fluorescent fixtures, and indirect HID and fluorescent fixtures designed to simply rest on top of a worksurface or binder bin of the systems furniture. Another disadvantage of movable lighting fixtures which merely rest on a worksurface or other horizontal support surface or which are supported on a floor stand, is that they tend to detract from the uniform aesthetics and integrated appearance which systems furniture are designed to achieve.

A configurable furniture integrated lighting system having interchangeable symmetric and asymmetric fixture heads, and a plurality of different supporting structures for supporting one of the fixture heads at a predetermined mounting height from a variety of different support surfaces associated with systems furniture is described in U.S. Pat. No. 5,276,597. The lighting system provides indirect lighting sources as desired at each of the individual workstations or office modules. In particular, this lighting system can be mounted to the systems furniture at various mounting heights using floor level supports, desk top surfaces, book shelf surfaces and binder bins. However, this lighting system provides only indirect light. In order to achieve a desired illumination and ambiance involving a combination of downwardly directed light and indirect lighting, the disclosed lighting system must be supplemented with lighting fixtures which direct light downwardly. This would increase lighting costs and detract from the uniform aesthetics and integrated appearance which are intended, thus negating many of the advantages of the integrated lighting system.

There remains a need for a modular light fixture for use with systems furniture which provides flexibility commensurate with that of the systems furniture, and which is adaptable to provide various combinations of direct and indirect light to achieve a desired level of illumination and a desired visual effect without producing glare. The modular light fixture should be capable of being mounted to, or above, the systems furniture using a variety of different support structures to permit the light fixture to be located in generally any position on or above an individual workstation or office module. It is also desirable that the light fixture be portable so that it can be remounted as desired to accommodate changing office needs and reconfiguration of the systems furniture. Portable lighting fixtures also offer advantages over architectural lighting. Specifically ownership of the fixtures may be with the tenant who can move them from one location to another, and may depreciate them over a shorter depreciation period. Desirably, the lighting fixtures would include a symmetrical fixture and an asymmetrical fixture to permit different placement opportunities. For example, the symmetrical fixtures could be located in unbounded spaces, while the asymmetrical fixtures could be located on vertical walls or partition surfaces. In order to provide improved flexibility and reconfigurability, and to reduce manufacturing costs, inventory control costs and other associated costs, the asymmetrical and symmetrical version should have as many common parts as possible.

SUMMARY OF THE INVENTION

This invention provides office lighting fixtures for use with systems furniture in open office spaces partitioned into individual workstations or office modules, which provides indirect upwardly directed lighting and selectively provides downwardly directed direct lighting, diffuse downwardly directed lighting or substantially no downwardly directed lighting, as desired. The lighting fixtures are configured to be mounted on the outer skin of an office partition panel, on posts projecting upwardly from the top of an office partition panel, or suspended from a ceiling above an office module or workstation. The lighting fixtures include a symmetrical version having a central ballast/electronics housings and at least one set of fluorescent tube support/electrical contacts on each side of the ballast/electronics housing, and an asymmetrical version having a ballast/electronics housing on one side of the fixture and at least one set of fluorescent tube support/electrical contacts on the other side of the fixture. The symmetric and asymmetric versions of the light fixtures are designed to share a plurality of components to provide parts interchangability, fixture reconfigurability, uniformity in appearance, and to reduce costs associated with manufacturing, distribution and inventory control.

The light fixtures of this invention have an uplight shade with an elongate downlight aperture and a removable baffle configured to cover the elongate downlight aperture to control the amount of downwardly directed light.

In accordance with one aspect of the invention, there is provided a light fixture having an elongate ballast/electronics housing having opposing ends, a pair of elongate side panels having opposing ends, and a pair of end pieces which are connected to, and supportingly engage the opposing ends of the ballast/electronics housing and the opposing ends of the side panel. The housing and side panels are laterally spaced apart, and together with the end pieces define an elongate downlight aperture. The side panels are positioned and orientated with respect to a light source mounted between the end pieces to act as a shade which reflects light upwardly from the light fixture. The asymmetric version includes end pieces which are configured to support a ballast/electronics housing on one side of the light fixture and to support at least one fluorescent tube on the other side of the fixture, laterally adjacent and generally parallel to the ballast/electronics housing. The asymmetrical version is generally designed to be supported on the outer skin of an office partition panel, but could conceivably be mounted on posts above the panel, suspended from a ceiling, or mounted on the top of a binder bin or other support surface. The symmetrical version includes end pieces which are configured to centrally support a ballast/electronics housing and at least one fluorescent tube on each side of the ballast/electronics housing. In either version a fluorescent tube may be supported directly above the ballast/electronics housing. The ballast/electronics housing is generally a U-shaped trough which is configured to be connected to the end pieces. A ballast/electronics housing cover plate is provided to cover the open top side of the U-shaped trough. The cover and U-shaped trough are configured to be connected to each, preferably with a snap-together type connection which allows the cover to be easily attached to the U-shaped trough without tools, and disconnected from the U-shaped trough with simple tools. Likewise, the U-shaped trough and end pieces can be configured with cooperating connectors which allow the U-shaped trough or channel and end pieces to be quickly attached together and disconnected from each other without tools.

The asymmetrical light fixture includes a single side panel which is connected at each end thereof to outer sides of asymmetrical end pieces which are opposite of the ballast/electronics housing, with a fluorescent tube disposed generally between the side panel and the ballast/electronics housing. The end pieces and side panel can be configured to allow the side panel to be easily connected to the end panels and disconnected from the end panels without tools. The side panel is arranged at an acute angle with respect to a horizontal plane so that it serves as a shade which reflects and redirects light from the fluorescent tubes in a generally upwardly direction. The side of the ballast/electronics housing which faces toward the side panel, together with the lower edge of the side panel, define an elongate downlight aperture. The downright aperture can be left open to provide a combination of primarily upwardly directed light which can reflect off of a ceiling and other surfaces above the fixture to provide indirect ambient lighting, and a minor component of downwardly directed light which can provide more intense illumination directly beneath the light fixture. The combination of indirect ambient lighting and direct lighting creates an interesting visual effect which may enhance office ambiance. It is envisioned that the asymmetrical light fixtures of this invention will be generally provided with an opaque baffle or translucent light-diffusing baffle, either of which may be positioned over the downlight aperture. The opaque baffle can be positioned in the downlight aperture and block substantially all of the downwardly directed light from projecting from the fixture and instead be redirected upwardly. Alternatively, the translucent light-diffusing baffle can be positioned over the downlight aperture to provide diffuse downwardly directed light if desired. This combination of upwardly directed indirect light and downwardly directed diffuse light provides excellent, uniform illumination and creates an interesting visual effect which may enhance office ambiance. Each of the baffles is preferably configured so that it can be inserted through the downlight aperture and be dropped into place and attached to the ballast/electronics housing at one side and on the side panel at the other side, so that the baffles can be quickly and easily installed, removed or replaced with another baffle, as desired.

The symmetrical light fixture includes two side panels, each of which is connected at opposite ends thereof to outer sides of symmetrical end pieces. The two side panels for the symmetrical light fixtures are preferably identical to and/or interchangeable with the side panel of the asymmetrical light fixture to reduce tooling cost and other costs associated with the manufacture, distribution, and sale of the light fixtures, and to provide increased flexibility with respect to reconfigurability of the fixtures. Likewise, the ballast/electronics housing and cover for the housing of the symmetrical light fixture are generally similar and can be identical to and/or interchangeable with those of the asymmetrical light fixture. The side panels are connected to the end pieces at opposing outer sides thereof, with at least one fluorescent tube disposed generally between each of the side panels and the ballast/electronics housing. Each of the side panels is arranged at an acute angle with respect to a horizontal plane so that it serves as a shade which reflects and redirects light from the fluorescent tube or tubes in a generally upwardly direction. Each of the opposing sides of the ballast/electronics housing, together with the lower edge of the side panel which the side of ballast/electronics housing faces, defines an elongate downlight aperture. Accordingly, the symmetrical light fixture includes a pair of generally parallel downlight apertures, each of which is generally located between the ballast/electronics housing and one of the side panels. The downlight apertures can be left open to provide a combination of primarily upwardly directed light which can reflect off of ceilings and other surfaces above the fixture to provide indirect ambient lighting, and a minor component of downwardly directed light, which can provide more intense illumination directly beneath the light fixture. It is contemplated that each symmetrical light fixture may be provided with a pair of opaque, light blocking baffles and a pair of translucent light diffusing baffles. The opaque and translucent baffles are preferably identically shaped and interchangeable with, those described above for the asymmetrical light fixture. Either of the two downlight apertures of the symmetrical light fixture can be independently left open, provided with an opaque baffle, or provided with a translucent light-diffusing baffle. For example, one of the downlight apertures can be left open while the other is provided with an opaque or translucent baffle, or one of the downlight apertures can be provided with an opaque baffle and the other with a translucent baffle. Such arrangements may be desirable such as when the symmetrical light fixture is mounted directly above the top rail of an office partition panel separating two adjacent office modules or workstations, and different lighting effects are desired in each of the adjacent office modules or workstations.

The light fixtures, and light fixture kits of this invention provide reconfigurable, modular fixtures which can be integrated into systems furniture and architectural structures to provide uniform aesthetics, wherein the light fixtures visually merge or blend in with the systems furniture to provide a clean, integrated appearance wherein the lighting is perceived as an extension of the furniture system. The light fixtures of this invention are highly efficient in that they can provide a combination of indirect ambient lighting and direct or diffuse light from a single fixture. The light fixtures of this invention can be easily reconfigured as desired using drop-in baffles to provide light fixtures which provide substantially only upwardly directed light for indirect ambient lighting, combinations of upwardly directed light only, and downwardly directed direct light, or a combination of upwardly directed light and downwardly directed diffuse light. The fixtures of this invention can be configured for mounting in a variety of different ways, such as to an outer skin or surface of an office partition panel, on posts projecting upwardly from the top of an office partition panel, or suspended from a ceiling or other overhead support, or mounted to architectural components.

DETAILED DESCRIPTION OF THE PREFERRED EMBODIMENTS

Figure 1:
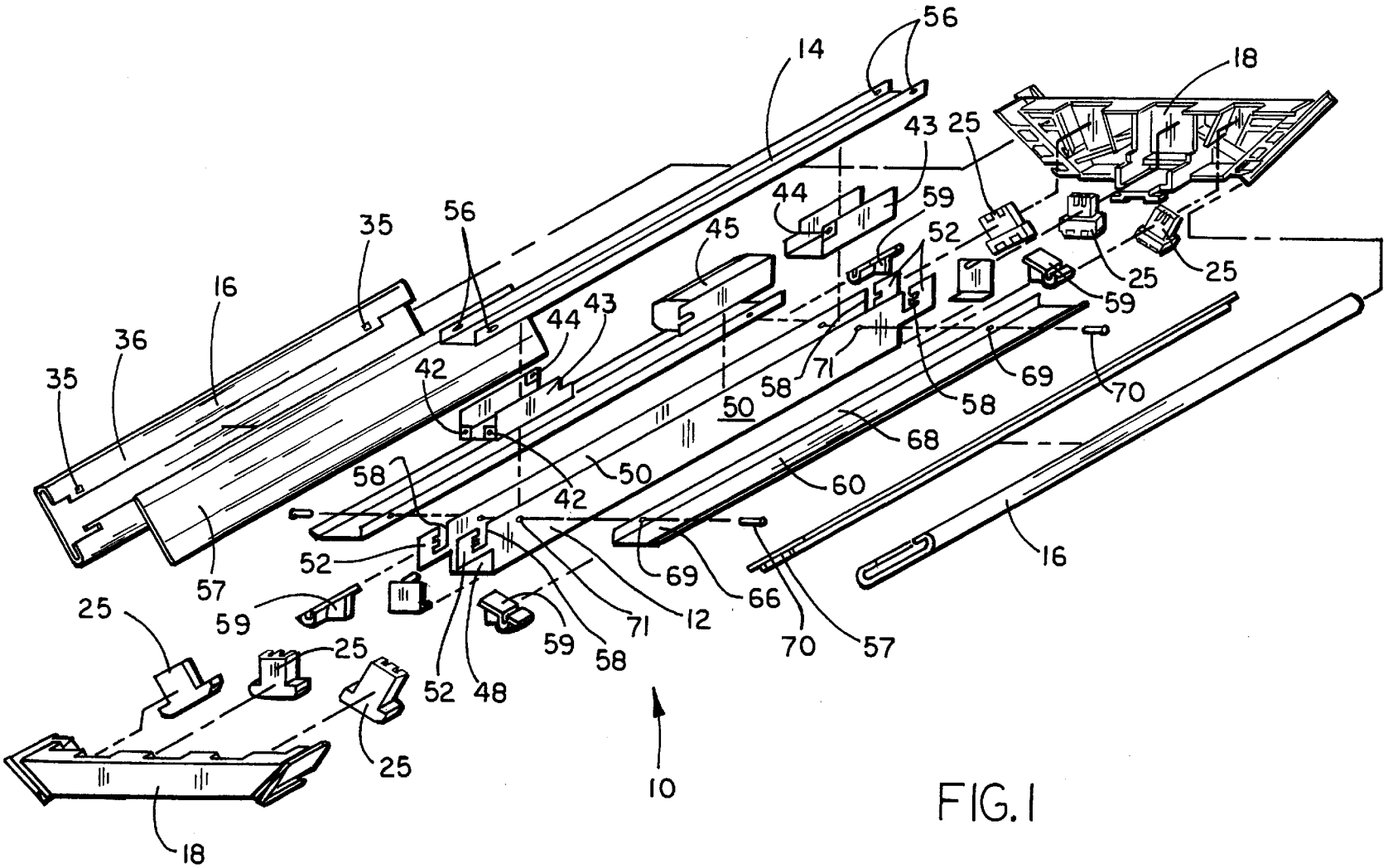
FIG. 1 is an exploded perspective view of an symmetrical light fixture in accordance with the invention showing the manner in which the light fixture is assembled.

Referring to FIG. 1, there is shown an exploded perspective view of a symmetrical light fixture 10 in accordance with the invention, to illustrate the manner in which the symmetrical light fixture is assembled. The symmetrical light fixture generally includes a U-shaped channel 12, and a cover plate 14, which together generally define a ballast/electronics housing; a pair of side panels 16; and a pair of symmetrical end pieces 18. In the assembled state, the end pieces 18 supportingly engage the opposing ends of the U-shaped channel 12 or housing and the opposing ends of the side panels 16 to form a generally trough shaped light fixture.

Figures 2, 6:
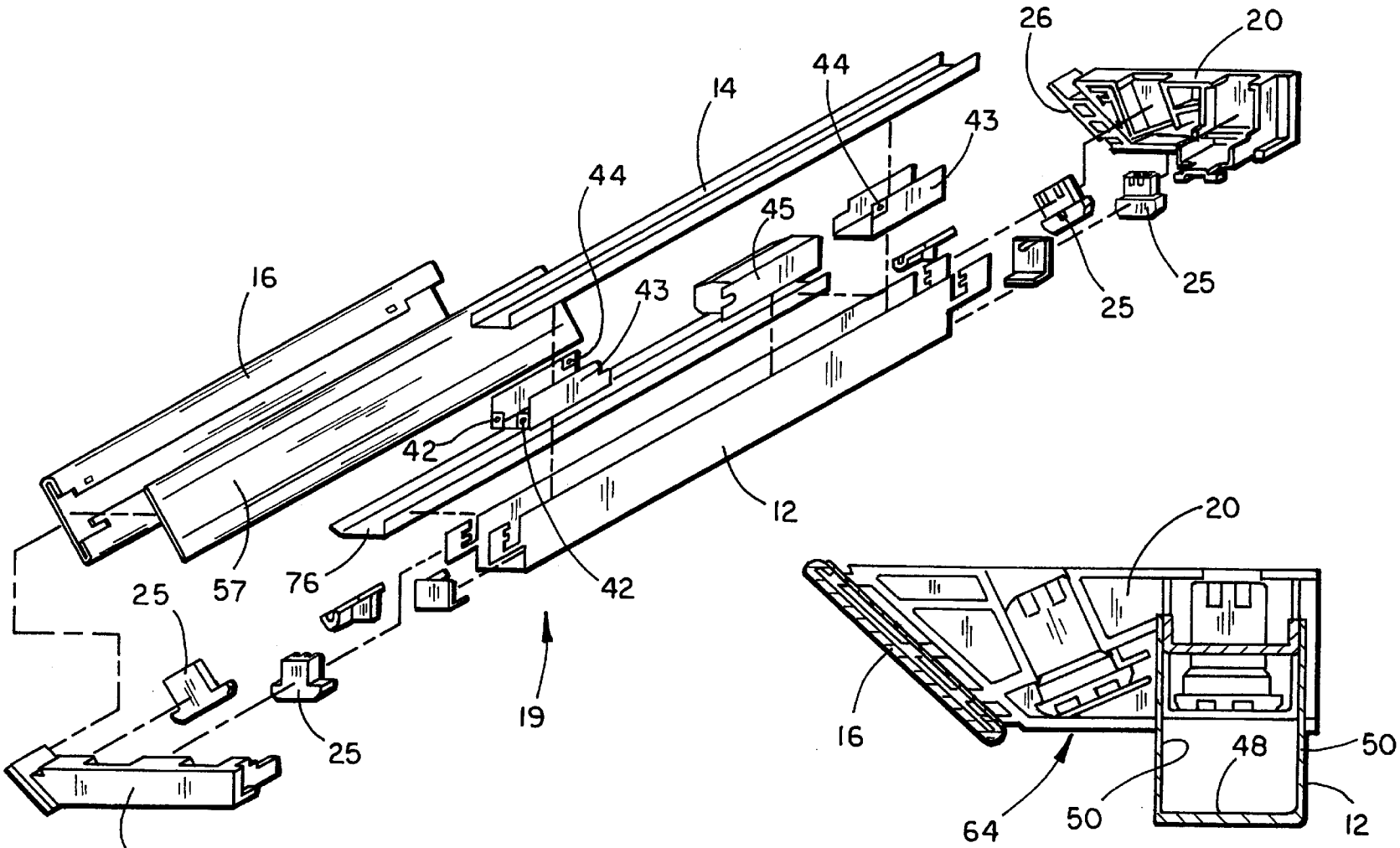
FIG. 2 is an exploded perspective view of an asymmetrical light fixture in accordance with the invention showing the manner in which it is assembled.
FIG. 6 is a transverse cross-sectional view of the asymmetrical light fixture in its assembled state.

In FIG. 2 there is shown an exploded perspective of the asymmetrical light fixture 19 generally illustrating the components thereof, and the manner in which it is assembled. As with the symmetrical light fixture, the asymmetrical light fixture includes a U-shaped channel 12 which is substantially identical to, and interchangeable with, the U-shaped channel used in the symmetrical light fixtures shown in FIG. 1. The asymmetrical light fixture also comprises a cover plate 14, and a side panel 16, which are substantially identical to, and interchangeable with, the corresponding parts shown in FIG. 1 for the symmetrical light fixture. The major difference between the asymmetrical light fixture and the symmetrical light fixture is that the asymmetrical light fixture has asymmetrical end pieces 20, which are substantially truncated versions of the symmetrical end pieces 18, and uses only one side panel 16, instead of two. Accordingly, the components of the light fixtures will be generally described with reference to the symmetric version, it being understood that such descriptions generally apply to the asymmetric version as well, the difference being apparent from reference to the drawings and this specification.

Figure 3:
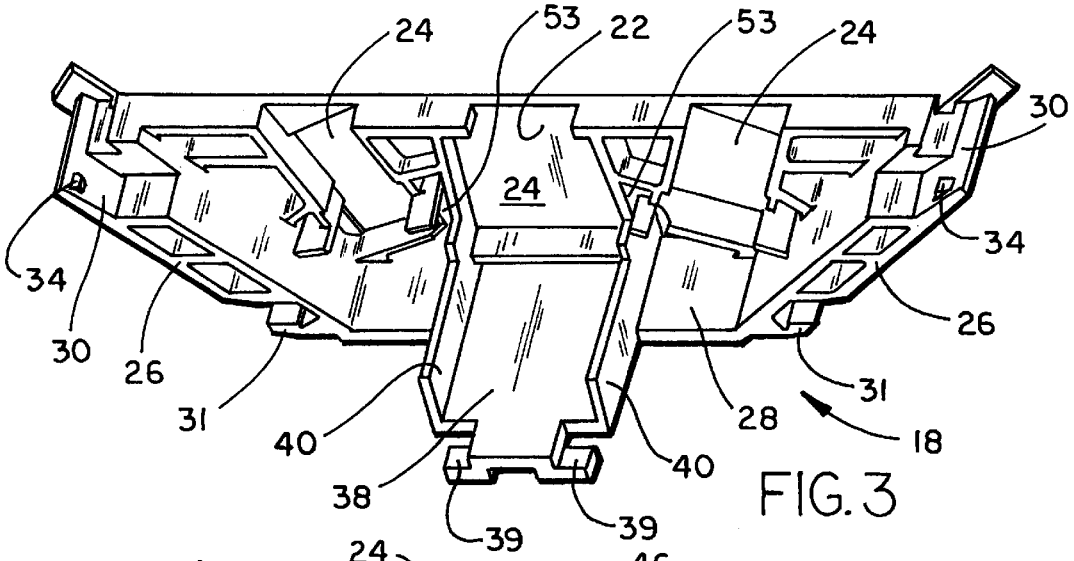
FIG. 3 is a perspective view of the symmetrical end piece shown in FIG. 1.
Figure 4:
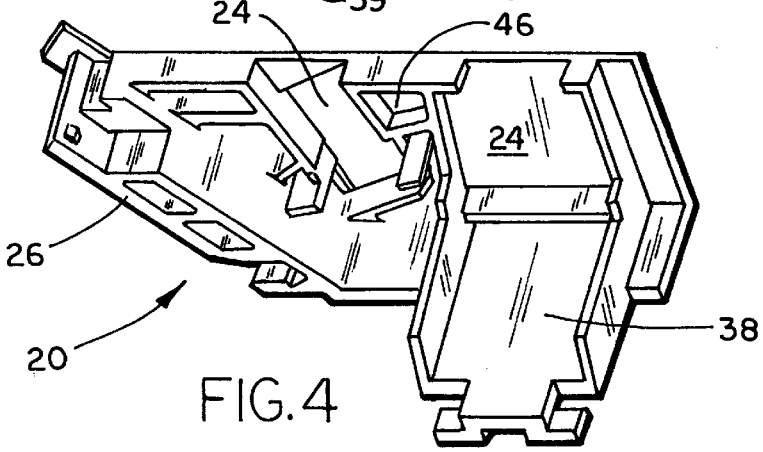
FIG. 4 is a perspective view of the asymmetrical end piece shown in FIG. 2.

The interior side of the symmetrical end piece 18 is shown in greater detail in FIG. 3. Symmetrical end piece 18 includes a vertical end wall 22 which is generally symmetrical with respect to a vertical plane which is perpendicular to the vertical end wall. The end wall defines a plurality of recesses 24, each of which is configured for receiving a fluorescent tube holder 25 (FIG. 1) with electrical contacts. Symmetrical end piece 18 also includes a pair of opposing side walls 26 which are angled to extend upwardly and outwardly away from a base 28. Each of the side walls 26 includes a relatively thin upper portion 30 and a lower hook portion 31 which are configured to be engaged by portions of panels 16 to achieve secure attachment of panels 16 to end pieces 18. Each of the portions 30 of end pieces 18 include a boss 34 which projects from the inner side of the side wall and extends through an aperture 35 in rails 36 of side panels 16 to retain the ends of panels 16 to the end pieces 18. Extending from end wall 22 of symmetrical end piece 18 and from the base 28 is an upwardly opening U-shaped channel portion 38 for aligning U-shaped channel 12 with symmetrical end piece 18. U-shaped channel portion 38 includes a pair of laterally spaced apart vertical walls 40. U-shaped channel 38 also includes a pair of positioning tabs 41 for cooperatively engaging alignment/retainer tabs 42 on a ballast mounting bracket 43. Bracket 43 also includes an aperture 44 for attaching ballast 45 thereto. The symmetrical end pieces 18 are preferably formed from a durable thermoplastic material using an injection molding technique.

The asymmetrical end pieces 20 are substantially truncated versions of the symmetrical end piece 18. In particular, the asymmetrical end piece includes a vertical end wall 46 which is substantially a truncated version of the vertical end wall 22. End wall 46 defines a pair of recesses 24 (substantially identical to recesses in the vertical wall of the symmetrical end piece) for receiving a fluorescent tube connector 25 having electrical contacts. The asymmetrical end piece 20 includes only one angled side wall 26, which is substantially identical to the angled side walls of the symmetrical end piece. The asymmetrical end piece 20 also includes a U-shaped channel portion 38, which is substantially identical to the U-shaped channel portion of the symmetrical end piece.

Figure 5:
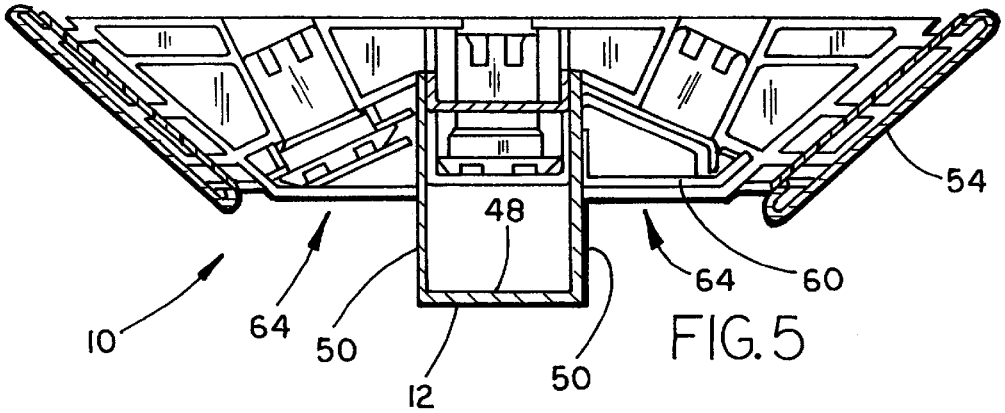
FIG. 5 is a transverse cross-sectional view of the symmetrical light fixture of FIG. 1 in its assembled state.

Referring to FIGS. 1 and 5, U-shaped channel 12 is an upwardly opening elongate channel member having a horizontal base 48 and vertical walls 50 which extend upwardly from the opposing ends of the base 48. The opposing ends of each of the vertical walls 50 include an extension 52 which extends longitudinally beyond the end of the base 48. The extensions 52 have an upper edge which is coincident with the upper edge of the main portion of the vertical walls 50, and a lower edge which is located between the upper edge and lower edge of the vertical walls. Each of the extensions 52 is configured to be tightly received within a recessed area 53 defined by end piece 18, such that U-shaped channel 12 is held to end piece 18 with sufficient force to facilitate assembly. After panels 16 are installed and locked into position by engagement between tabs 34 of end pieces 18 and aperture 35, the spacing between the opposing and pieces becomes fixed and extensions 52 cannot be displaced relative to the recesses 53, thus securely locking channel 12 between the end pieces 18. The U-shaped channel 12 is preferably formed from metal sheets, such as steel or aluminum, using standard metal sheet cutting, stamping and shaping operations. However, other materials can be used to form the U-shaped channel.

Referring again to FIGS. 1 and 5, side panels 16 each include an outer exposed wall 54 and a pair of rails 36 which project from the rear side of the side panel 16 and extend along a plane parallel to wall 54 adjacent the opposing lateral edges of panels 16. The rails 36 are arranged in space apart parallel relationship to each other and extend along generally the entire length of the side panel 16. At each end of each rail 36 an aperture 35 is defined. Each aperture 35 is configured to engage a boss 34 of side wall portion 30 of end piece 18 or 20. Side panels 16 are preferably formed from sheets of metal such as steel or aluminum using standard metal cutting, stamping, and forming techniques. Side panel 16, however, can be made from other materials, such as extruded or injection molded plastics, extruded aluminum, etc. Side panel 16 is connected to end piece 18 or 20 by aligning rails 36 with wall portion 30 and hook portion 31 in side wall 26 of end piece 18 or 20, and urging the side panel and end piece together until bosses 34 project through notches 36.

Referring to FIGS. 5 and 6, cover plate 14 is an elongate panel which is sized and configured to serve as a snap-on closure for U-shaped channel 12. U-shaped channel 12 and cover plate 14 together define a ballast/electronics housing, containing one or more ballasts, and associated electrical components and wiring. Cover plate 14 includes resilient embossments 56 which are configured to resiliently engage notches 58 which are cut into the upper edges of vertical walls 50 of U-shaped channel 12. Cover plate 14 is preferably formed from metal sheets such as steel or aluminum using standard metal cutting, stamping and forming techniques. However, cover plate 14 can be made from other materials such as plastics which can be extruded or injection molded. Cover plate 14 can be attached to U-shaped channel 12 by engaging the resilient embossments 56 on one side of the cover plate with a notch 58 on a first side of the U-shaped channel 12 and temporarily deforming the cover plate 14 on the second side of the cover plate to permit engagement of embossments 56 with notches 58 on the second side of the ballast/electronics housing. Notches 58 are also configured to receive and retain a wire cover 59 to cover electrical wires which connect the ballast 45 with the electrical contacts on fluorescent tube connectors 25.

In order to minimize the amount of light which is absorbed by the surfaces of the light fixture and increase the amount of light available for illumination, reflector panels 57 can be mounted on the inside face of panels 16 in any suitable manner.

The symmetrical light fixture can be assembled by connecting U-shaped channel 12 to a first symmetrical end piece 18, as described above; connecting one end of side panel 16 to the first symmetrical end piece 18, as described above; aligning the opposing, unconnected ends of the U-shaped channel 12 and side panel 16 with the U-shaped channel connector 38 and side walls 26 of a second symmetrical end piece 18; and urging the second symmetrical end piece toward the channel 12 and side panel 16, as described above. It is contemplated that the fluorescent tube holders with electrical contacts will be pre-installed in recesses 24, and that the ballast, other electronics and associated wiring will be pre-mounted in the U-shaped channel 12. Of course, appropriate wiring must be provided between the ballast and electronics in the ballast/electronics housing and the contacts in the fluorescent tube holder mounted in the symmetrical end pieces 18. Thereafter, cover plate 14 is mounted on U-shaped channel 12 as described above. The asymmetrical fixture is assembled in a substantially similar manner, except that only one side panel 16 is utilized.

In the case of the symmetrical light fixture, the symmetrical end pieces 18, ballast/electronics housing defined by U-shaped channel 12, and the side panel 16, together define a pair of elongate downlight apertures which are generally parallel to one another. In the case of the asymmetrical light fixture, only a single elongate downlight aperture is defined by the end pieces 20, ballast/electronics housing defined by U-shaped channel 12, and the side panel 16.

The downlight apertures can remain open if desired to provide a combination of upwardly directed light and downwardly direct light. Alternatively, the downlight apertures can be covered with a shade to block substantially all of the downwardly directed light and reflect it back upwardly, or a light diffuser can be mounted into the downlight aperture to provide a combination of upwardly directed light and downwardly directed diffuse light. With reference to FIG. 5, there is shown a shade 60 mounted in one of the downlight apertures 64 of a symmetrical light fixture 10. The other downlight aperture 64 of the symmetrical fixture 62 has been left open. Accordingly, the fixture 10 shown in FIG. 5 can be used above an office partition panel to provide a combination of upwardly directed light with substantially no downwardly directed light on one side of the office partition panel and to provide direct downright on the other side of the office partition panel. The shade 60 is an elongate member having a length which is substantially equal to that of the downlight aperture 64. Shade 60 includes horizontal wall section 66 which substantially fills the gap between the channel 12 and side panel 16 defining aperture 64. Projecting upwardly at a right angle from one of the lateral edges of section 66 is a support leg 68 having a pair of connection apertures 69 through which fasteners 70 can extend through and into apertures 71 on the U-shaped channel to attach the shade 60 thereto. Shade 60 can be removed from fixture 62 by simply removing fasteners 70 and allowing shade 60 to drop from the downlight aperture 64. In FIG. 2 there is shown a translucent, light diffusing baffle 76. Light diffusing baffle 76 has a shape and dimension which are substantially identical to that of opaque shade 60. The primary difference between shade 60 and diffuser 76 being the materials used in the formation thereof. Shade 60 can be formed of generally any suitable opaque material such as metal or an opaque plastic. The translucent, light diffusing baffle 76 can be formed of a translucent, light diffusing plastic material. Shade 60 and diffuser 76 can be formed by extrusion or injection molding of a suitable plastic material. Alternatively, shade 60 can be made from metal sheet material such as steel or aluminum using standard metal cutting, stamping and shaping techniques.

Figure 7:
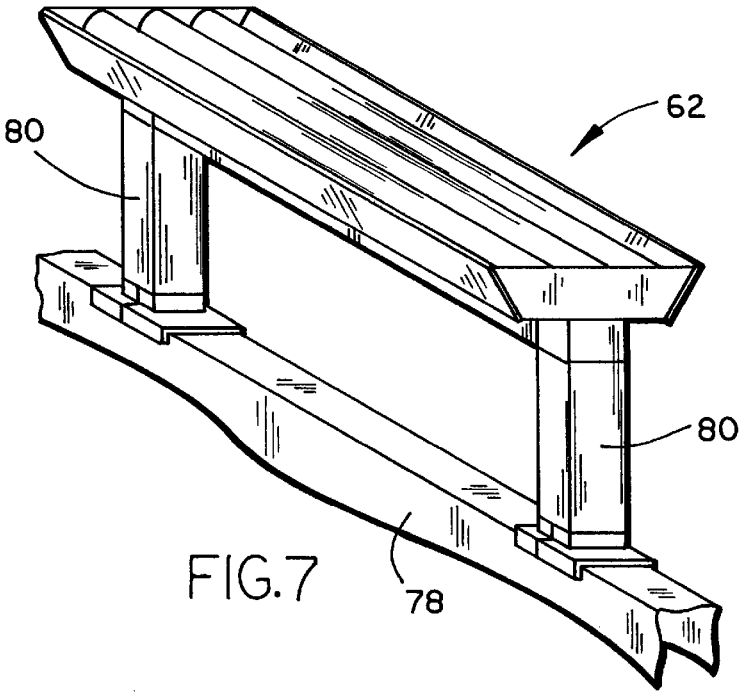
FIG. 7 is a perspective view of the symmetrical light fixture mounted on posts extending from the top rail of an office partition panel.
Figure 8:
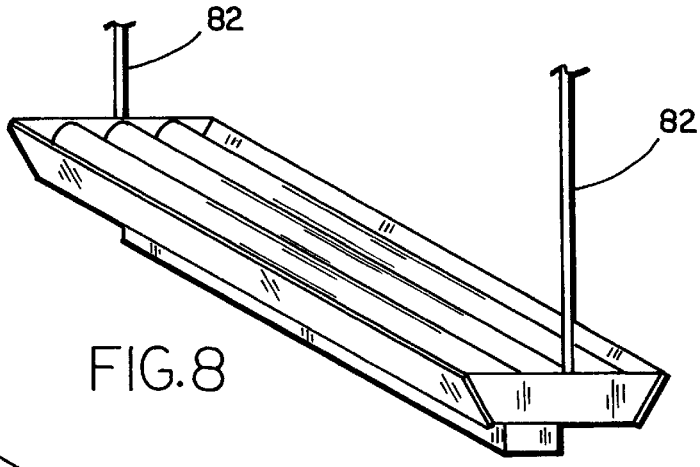
FIG. 8 is a perspective view of the symmetrical light fixture suspended from a ceiling.
Figure 9:
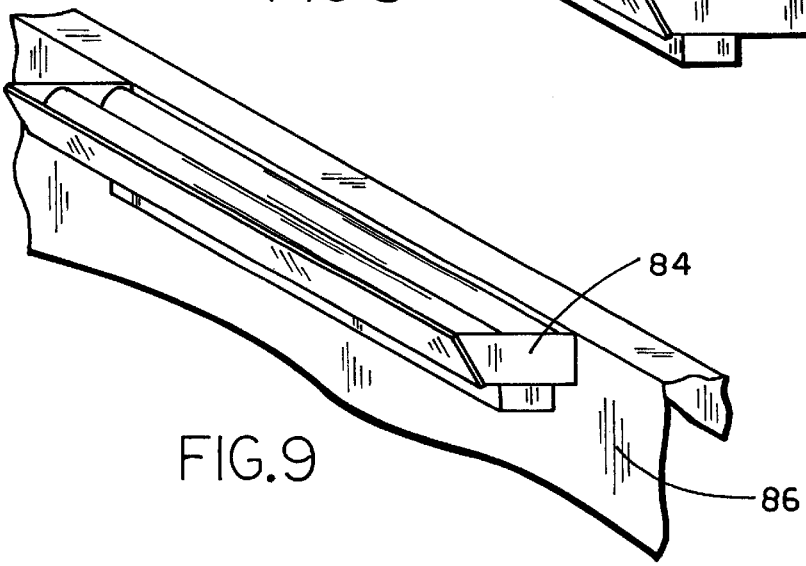
FIG. 9 is a perspective view of the asymmetrical light fixture mounted on the outer skin or surface of an office partition wall.

As shown in FIG. 7, the symmetrical light fixture 62 is well adapted for symmetrically mounting a light fixture above the top of an office partition panel 78 to provide direct and/or indirect ambient lighting to office areas on each side of the office partition panel. In particular, light fixture 62 is shown mounted on stanchions 80 which are connected to the top of the office panel 78. In FIG. 8 the symmetrical light fixture 62 is shown suspended from a ceiling using suspension means 82. In FIG. 9, an asymmetrical light fixture 84 is shown mounted to the outer skin or surface of an office partition panel 86. FIGS. 7–9 illustrate preferred methods of mounting the symmetrical and asymmetrical fixtures. However, it is contemplated that the fixtures can be mounted in a variety of other ways, such as on top of book cases, file cabinets, architectural components, etc.

It will be apparent to those skilled in the art that various modifications to the preferred embodiment of the invention as described herein can be made without departing from the spirit or scope of the invention as defined by the appended claims.

The embodiments of the invention in which an exclusive property or privilege is claimed are defined as follows:

1. A light fixture comprising:

an elongate ballast housing having opposing ends;

an elongate shade having opposing ends;

a pair of end pieces supportingly engaging the opposing ends of the ballast housing and the opposing ends of the shade, the housing and shade being laterally spaced apart and together with the end pieces defining an elongate downlight aperture, a light source positioned above the downlight aperture and mounted between the end pieces, the shade being positioned and orientated with respect to the light source to reflect light upwardly from the light fixture; and a baffle removably attached to the housing to cover the downlight aperture to block downwardly directed light from the light source and redirect the light from the light source upwardly, the baffle being detachable from the housing to allow light from the light source to be directed downwardly through the downlight aperture.

2. The light fixture of claim 1, wherein the baffle is opaque to block out substantially all downwardly directed light.

3. The light fixture of claim 1, wherein the baffle is translucent to provide downwardly directed diffuse light.

4. The light fixture of claim 1, wherein the end pieces are symmetrical and supportingly engage the side panels to form a symmetrical light fixture having a pair of generally parallel, laterally spaced apart elongate downlight apertures.

5. The light fixture of claim 1, wherein the end pieces are asymmetrical and supportingly engage the opposing ends of only one side panel to form an asymmetrical light fixture having only one elongate downlight aperture.

6. A light fixture comprising:

a housing defining a downlight aperture;

a light source disposed within the housing above the downlight aperture; and a baffle removably attached to the housing to cover the downlight aperture to block downwardly directed light from the light source and redirect the light from the light source upwardly, the baffle being detachable from the housing to allow light from the light source to be directed downwardly through the downlight aperture.

7. The light fixture of claim 6, wherein the baffle is opaque to block out substantially all downwardly directed light.

8. The light fixture of claim 6, wherein the baffle is transparent to provide downwardly directed diffuse light.

9. The light fixture of claim 6, wherein the housing is partially defined by an opaque planar uplight shade, the plane of the uplight shade being arranged at an acute angle with respect to a horizontal plane to reflect light generally upwardly from the uplight shade.

10. A light fixture comprising:

a light source;

an opaque planar uplight shade located adjacent the light source, the plane of the shade being arranged at an acute angle with respect to a horizontal plane to reflect light generally upwardly from the uplight shade;

a ballast housing;

the shade and ballast housing defining an elongate downlight aperture; and a removable baffle attached to the housing to cover the downlight aperture to block downwardly directed light from the light source and redirect the light from the light source upwardly, the baffle being detachable from the housing to allow light from the light source to be directed downwardly through the downlight aperture.

11. The light fixture of claim 10, wherein the baffle is opaque.

12. The light fixture of claim 10, wherein the baffle is translucent.

* * * * *